United States Patent [19]

Cerutti

[11] Patent Number: 4,769,192

[45] Date of Patent: Sep. 6, 1988

[54] PULSATING SLIP FORM APPARATUS AND METHOD

[75] Inventor: Henry P. Cerutti, Seminole, Pa.

[73] Assignee: Blaw Knox Corporation, Pittsburgh, Pa.

[21] Appl. No.: 31,278

[22] Filed: Mar. 27, 1987

[51] Int. Cl.[4] ..... E04B 1/16; E21D 11/10

[52] U.S. Cl. ..... 264/33; 405/146; 425/59; 425/63

[58] Field of Search ..... 405/141, 142, 144, 146, 405/150, 155; 264/31-35; 425/59, 63, 64

[56] References Cited

U.S. PATENT DOCUMENTS

| | | | |
|---|---|---|---|
| 1,246,134 | 11/1917 | Meem | 405/141 |
| 1,716,125 | 6/1929 | Hackley | 425/59 |
| 1,867,837 | 7/1932 | Jackson | 264/31 |
| 2,486,801 | 11/1949 | Sarosdy | 425/63 |
| 3,193,901 | 7/1965 | Lee et al. | 425/59 |
| 3,788,087 | 1/1974 | Patin | 405/141 |
| 4,125,579 | 11/1978 | Barber et al. | 264/32 |
| 4,437,788 | 3/1984 | Walbrohl | 405/146 |
| 4,456,401 | 6/1984 | Williams | 405/150 |
| 4,600,373 | 7/1986 | Swanson | 425/144 |

*Primary Examiner*—David H. Corbin

*Attorney, Agent, or Firm*—Webb, Burden, Ziesenheim & Webb

[57] ABSTRACT

A method and apparatus for forming wet concrete employing a slip form having a radially expandable elastic outer shell comprising pouring concrete around the exterior surface of the outer shell and applying a fluid under pressure to the interior surface of the outer shell. The pressure of the fluid is pulsated so that the outer shell expands and contracts to reduce the friction between the outer shell and the concrete. The reduction in friction allows the form to be moved longitudinally along the concrete with reduced tearing of the surface of the concrete.

12 Claims, 3 Drawing Sheets

PULSATING SLIP FORM APPARATUS AND METHOD

The invention relates to a slip form structure and method for shaping wet concrete in the construction of tunnels, shafts, towers, silos, median barriers, etc. More particularly, this invention relates to structure and method which employs a pulsating slip form to reduce tearing of fresh concrete as the form moves longitudinally along a fresh concrete surface.

The slip form structure of this invention is caused to pulsate by periodic expansion and contraction of the outer periphery of the form to diminish or prevent tearing of fresh concrete by the slip form as the form moves past the setting concrete. The exterior shell of the slip form comprises a relatively thin member under the influence of a hydraulic or other fluid on the interior surface of the shell whose pressure is pulsating. The pressure pulsation causes the thin member to expand and contract in cycles to diminish adhesion of the form to the concrete as the concrete sets. The expansion and contraction of the shell affects the thickness of the shell wall and induces a varying tensile stress in the shell wall.

This invention is particularly adapted to forming a concrete lining in a tunnel using a longitudinally moving slip form which pulsates radially under the influence of a pressure pulsating hydraulic medium. It is within the purview of this invention to employ air bags or other means to pulsate a skin in small increments sufficiently slowly to reduce or eliminate tearing action on the concrete as the form moves forward. The pulsating action of this invention reduces the force required to move the form forward.

In the past, any delay in the supply of concrete to a slip form or any slowdown, such as a mechanical failure, caused the form to be concreted into the structure. Even in the absence of a delay, the friction between the form and the fresh concrete upon longitudinal movement of the form produced a concrete surface that was porous and often unsightly. The tearing action between the shell and the concrete was minimal in small structures where the concrete pressure was small but the tearing action increased in large structures which require high concrete pressures. In contrast, in accordance with this invention, tearing action is greatly inhibited even in large structures.

The frequency of the pulsation cycles can be variable because of variability in the factors which affect the setting time of the concrete. In one example, an expansion and contraction cycle can occur every 15 seconds. The cycle time can vary with changes in cement, aggregates, temperature and additives. If a mechanical breakdown occurs, the form can be expanded in a radial direction to its maximum design diameter so that upon startup the form can be contracted in a radial direction to its minimum design diameter to separate the skin of the form from the concrete thereby allowing the slip form to move longitudinally with a reduced friction.

In a preferred embodiment, the slip form comprises inner and outer cylindrical shells with an annular space therebetween. The outer shell is relatively thin and the inner shell is relatively thick. A hydraulic or other fluid is supplied to the annular space and the pressure of the fluid is pulsated, i.e. the pressure is increased to a maximum and decreased to a minimum in regular or irregular periodic cycles. The inner shell can be substantially unstretchable at the pressures applied. However, the outer shell is sufficiently thin that it is elastic at the applied pressures. Thereby, the outer shell will stretch under tensile stress causing thinning of the plate constituting the shell. The applied fluid pressure is limited so that the tensile stress is below yield stress at all times, thereby maintaining elasticity throughout. In each cycle, the plate will stretch to a maximum stress at maximum pressure and will shrink back to a minimum stress for the cycle at the minimum pressure of the cycle, which may or may not be atmospheric pressure. This applying and removing of fluid pressure to the elastic outer shell causes its diameter to expand and contract, i.e. the radial displacement of the thin outer wall cylinder pulsates.

The thin outer shell can comprise any suitable elastic material. For example, it can comprise a metalliferous material such as steel or a thick rubber skin underlain with a steel support. Any convenient pulsation frequency can be employed, such as from one cycle every 0.1 minutes to one cycle every 5 minutes. This frequency range is sharply contrasted to vibration frequency ranges which are in the order of magnitude of thousands of cycles a minute.

In a sample calculation to determine differential elastic radial displacement of a thin wall cylinder due to internal pressure, assume a steel cylinder having a radius R of 60 inches, a thickness t of 0.125 inch, and a 100,000 psi tensile stress at yield. The pressure P (psi) required to induce a tensile stress s of 50,000 psi in the plate is:

$$P=(st)/R=(50{,}000\times 0.125)/60=104 \text{ psi}$$

The radial displacement u (inches) at 50,000 psi tensile stress using a modulus of elasticity E of $29\times 10^6$ psi is:

$$u=(Rs)/E=(60\times 50{,}000)/(29\times 10^6)=0.1034 \text{ inch}$$

Therefore, an internal hydraulic pressure of 104 psi applied to a 10 foot diameter cylinder will increase its diameter to 120.2068 inches.

This invention will be more completely understood by reference to the attached drawings wherein.

Figure 1:
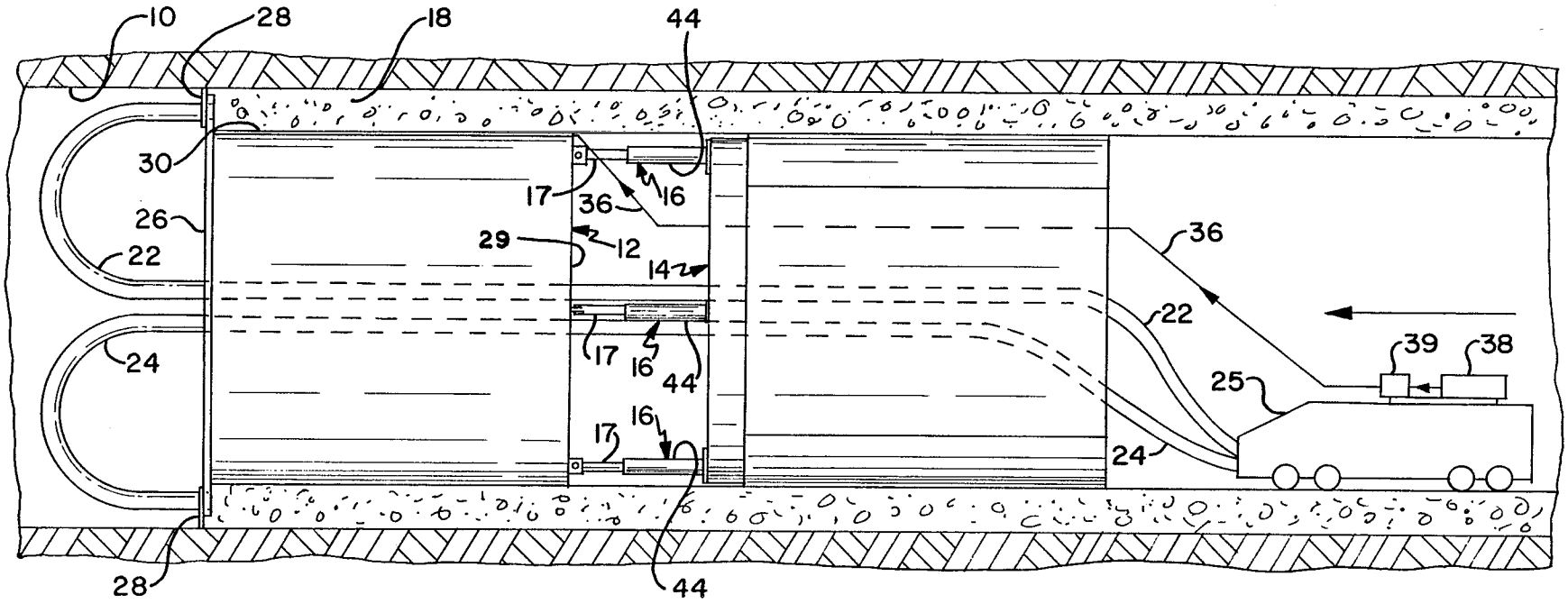
FIGS. 1 and 2 are side views of a longitudinally movable slip form of this invention disposed within a tunnel and in cooperative attachment to driving means.
Figure 2:
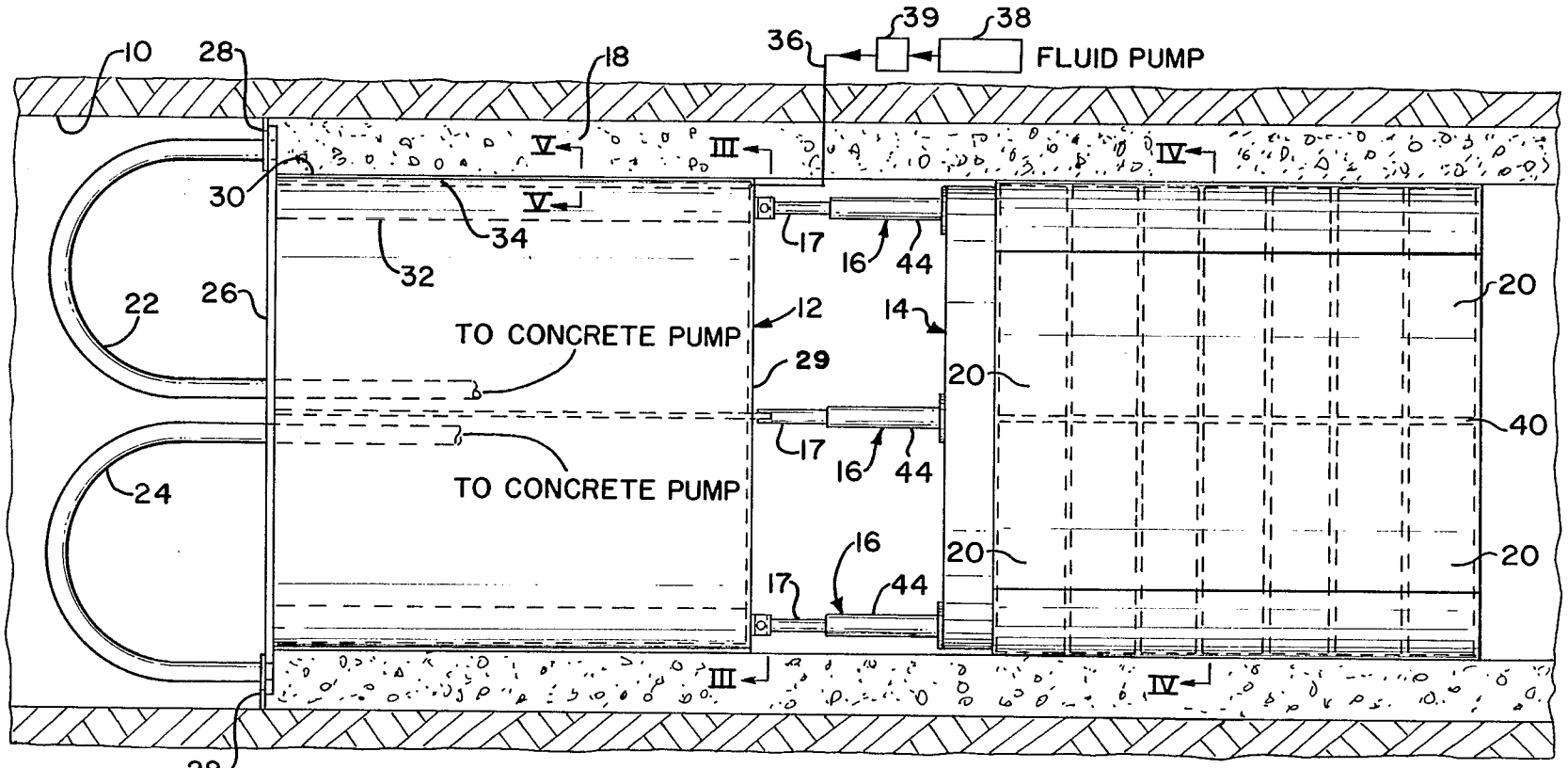

FIGS. 1 and 2 show earth bore 10 through which slip form 12 is longitudinally driven by driving means 14. A plurality of double acting piston and cylinder means 16 are connected between slip form 12 and driving means 14. Slip form 12 forms a concrete lining 18 along the surface of earth bore 10. Driving means 14 is comprised of a plurality of circumferential members 20 which are caused to bear against concrete lining 18 to provide a support bearing for driving means 14 while pistons 17 force an advance in the longitudinal position of slip form 12.

A pair of conduits 22 and 24 extend from mobile concrete pump 25 through the hollow interior of slip form 12 and in a U-bend path to discharge concrete at the leading edge of concrete lining 18. The leading edge of concrete lining 18 is defined by front bulkhead 26 and outer plate 28 each at the front of slip form 12. Front bulkhead 26 constitutes the front plate of slip form 12. Rear plate 29 constitutes the rear enclosure of slip form 12.

Figure 3:
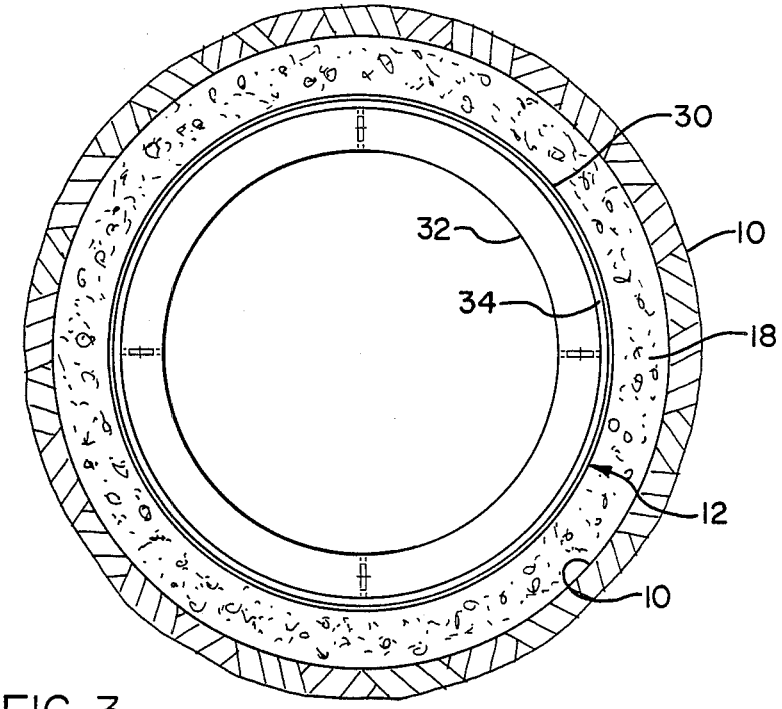
FIG. 3 is a transverse view of the slip form taken along the section III—III shown in FIG. 2.
Figure 5:
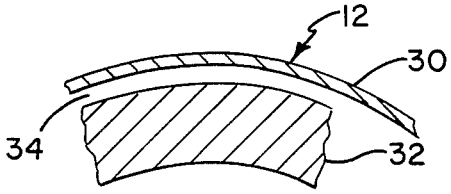
FIG. 5 is a cross-sectional view of a fragment of the slip form taken along the section V—V of FIG. 2.

Slip form 12 is comprised of outer and inner concentric cylindrical shells 30 and 32, respectively, to define annular space 34 therebetween. This structure is shown in FIGS. 2, 3 and 5. FIGS. 1 and 2 shows a schematic fluid line 36 extending to annular space 34 from fluid pump 38 for supplying hydraulic fluid to annular space 34. Line 36 is provided with pressure regulating means 39 to induce a pulsating or variable pressure in the hydraulic fluid in annular space 34. Fluid pump 38 and pressure regulating means 39 can be mounted on mobile concrete pump 25, as shown in FIG. 1. Outer shell 30 is sufficiently thin and elastic that it expands and contracts radially in a pulsating manner in response to the pulsating pressure variations. The expansion and contraction diminishes adhesion of outer shell 30 to concrete layer 18 as freshly pumped concrete solidifies around outer shell 30.

Figure 4:
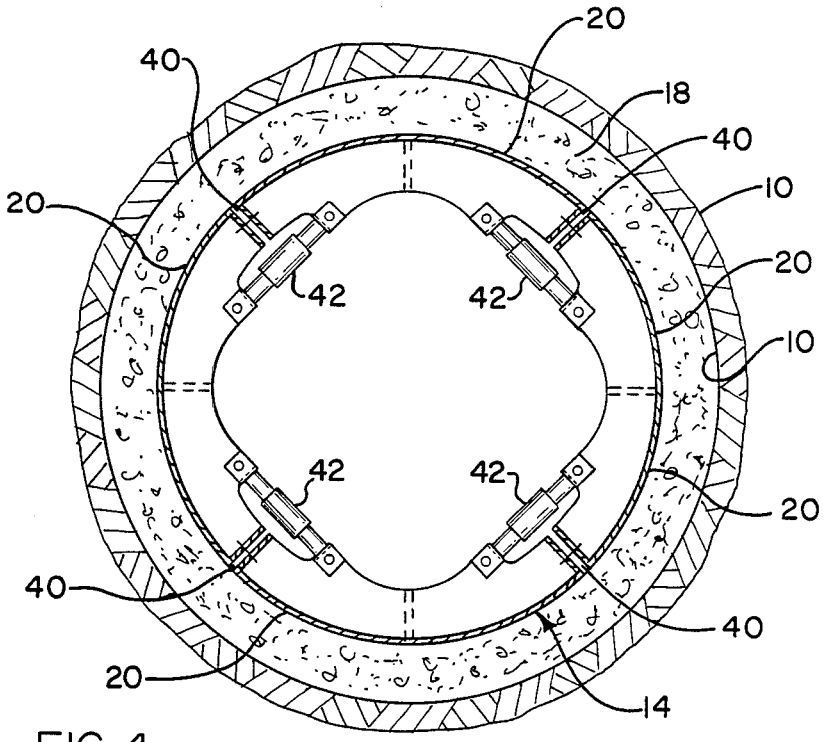
FIG. 4 is a transverse view of the driving means taken along the section IV—IV shown in FIG. 2.

Driving means 14 is comprised of a plurality of circumferential curved members 20, each extending over a quarter of a circumference. The quartered separation of plates 20 is indicated at positions 40 on FIGS. 2 and 4. Each curved quarter member 20 is forced outwardly against concrete lining 18 by means of its respective piston-cylinder assembly 42, shown in FIG. 4, when a stationary bearing for driving means 14 is desired. When driving means 14 has a stationary bearing, the extension of pistons 17 forces slip form 12 to advance in a forwardly or longitudinal direction through the tunnel.

The double acting piston and cylinder means 16 exerts a push-pull function. After pistons 17 have reached their full extension in pushing slip form 12, pistons 42 release the pressure upon quarter plates 20 permitting these plates to retract somewhat from concrete lining 18. At the same time, an extended maximum hydraulic pressure is exerted against outer cylinder 30 of slip form 12 to establish a fixed bearing of slip form 12 against concrete lining 18. Now, with slip form 12 providing the stationary bearing, cylinders 44 are drawn over pistons 17 to advance driving means 14 to a more forward piston, whereupon the push-pull action is repeated.

I claim:

1. A pulsating slip form comprising an elastic radially expandable metalliferous outer shell, said outer shell having an outer surface and an inner surface, said outer surface comprising a form for wet concrete, said inner surface exposed to a fluid under pressure, means for pulsating the pressure of said fluid, and said shell expanding and contracting under the influence of said pulsating pressure to reduce the friction between said outer surface and said concrete.

2. The slip form of claim 1 wherein said shell is comprised of steel and said expanding and contracting is accomplished by increases and decreases, respectively, in tensile stress in said steel.

3. The slip form of claim 1 wherein the frequency of pulsation is between 0.1 cycles/minute to 5 cycles/minute.

4. The slip form of claim 1 wherein said shell is comprised of rubber and steel.

5. The slip form of claim 1 including driving means for forcing the longitudinal advance of said slip form along the concrete.

6. A pulsating slip form comprising concentric inner and outer shells with an annular space therebetween, said outer shell comprising steel and having an outer surface with said outer surface comprising a form for wet concrete, said annular space containing a fluid under pressure, means for pulsating the pressure of said fluid, and said outer shell being elastic and expanding and contracting radially under the influence of said pulsating pressure to reduce the friction between said outer surface and the surface of said concrete.

7. The slip form of claim 6 wherein said outer shell is relatively thin and said inner shell is relatively thick.

8. The slip form of claim 6 including driving means for forcing the longitudinal advance of said slip form along said concrete.

9. A method for forming wet concrete with a slip form having a radially expandable elastic outer shell, said outer shell comprising metalliferous material and having an outer surface for forming concrete and an inner surface, said method comprising pouring concrete around said outer surface, applying a fluid under pressure to said inner surface, pulsating the pressure of said fluid to cyclically radially expand and contract said elastic outer shell to reduce the friction between said outer shell and said concrete, and moving said slip form longitudinally along the formed concrete.

10. The method of claim 9 wherein said expansion and contraction occurs while increasing and decreasing, respectively, the tensile stress in said outer shell.

11. The method of claim 9 wherein the frequency of said expansion and contraction is between 0.1 cycles/minute and 5 cycles/minute.

12. A method for forming concrete with a slip form which provides for interruptions in longitudinal movement of said slip form, said method comprising employing a concrete forming steel outer shell on said slip form which is radially expandable under the influence of a variable pressure fluid on the opposite side of said shell from said concrete, maximizing the pressure of said fluid upon an interruption in movement of said form to increase the diameter of said form, and reducing the pressure of said fluid to reduce said diameter and separate said shell from the concrete when longitudinal movement of said slip form is to begin.

* * * * *